United States Patent [19]

Hackett

[11] Patent Number: 4,899,795

[45] Date of Patent: Feb. 13, 1990

[54] LATHE AND INDEXING JIG FOR TABLE SAWS

[76] Inventor: Larry Hackett, 309 Park Dr., Glenwood Springs, Colo. 81601

[21] Appl. No.: 354,731

[22] Filed: May 22, 1989

[51] Int. Cl.[4] ..... B27C 5/00

[52] U.S. Cl. ..... 144/138; 83/435; 82/115; 82/128; 82/149; 142/2; 142/52; 144/2 R; 144/198 A; 144/253 R; 144/363; 33/642

[58] Field of Search ..... 33/642; 82/115, 128, 82/149; 83/439; 142/2, 52; 144/134 R, 2 R, 198 R, 198 A, 138, 205, 206, 363

[56] References Cited

U.S. PATENT DOCUMENTS

| | | | |
|---|---|---|---|
| 2,001,306 | 5/1935 | Gressner | 144/138 |
| 2,085,236 | 6/1937 | Tautz | 144/198 A |
| 2,435,382 | 2/1948 | Caskey . | |
| 2,594,651 | 4/1952 | Jackson . | |
| 2,715,924 | 8/1955 | Norris . | |
| 2,736,349 | 2/1956 | Francis . | |
| 2,766,785 | 10/1956 | Joyal . | |
| 2,895,513 | 7/1959 | Cowley | 144/198 A |
| 2,916,063 | 12/1959 | Boekenkamp . | |
| 2,918,953 | 12/1959 | Wraight . | |
| 2,941,556 | 6/1960 | hammerling . | |
| 2,978,814 | 4/1961 | Burhans . | |
| 3,116,769 | 1/1964 | Gunderson | 144/138 |
| 3,438,412 | 4/1969 | Zeigler . | |
| 3,786,712 | 1/1974 | Mackin . | |
| 4,132,253 | 1/1979 | Mills . | |
| 4,275,777 | 6/1981 | Briggs . | |
| 4,441,394 | 4/1984 | Barsotti . | |
| 4,516,612 | 5/1985 | Wiley . | |
| 4,655,445 | 4/1987 | Morse . | |
| 4,732,182 | 3/1988 | Gorsha | 144/198 A |

*Primary Examiner*—W. Donald Bray
*Attorney, Agent, or Firm*—Jacobson and Johnson

[57] ABSTRACT

The device includes a bed plate which can be placed on the table of a table saw and held against the rip fence and onto the table top by a block clamped to the rip fence which allows the bed to be moved fore-and-aft upon the table top parallel to the saw balde. A live center and a dead center are provided to hold a work piece therebetween parallel to the saw blade. In one aspect of the invention the work piece can be indexed and engage the saw blade to cut three or more equidistant lengthwise facets thereon. In another aspect these facets can be tapered end to end or from the center to each end by shifting the tail stock towards the blade or by first shifting the tail stock and then the head stock. In a still further aspect, the head stock includes means to rotate the work piece by a source of power so that a tapered cylindrical shape may be cut or dowels may be formed.

20 Claims, 4 Drawing Sheets

LATHE AND INDEXING JIG FOR TABLE SAWS

This invention relates to new and useful improvements in table saw lathe and indexing jigs, and comprises means whereby both a plurality of facets may be formed upon a work piece such as a length of wood or alternatively, the work piece may be rotated by a separate source of power in a manner similar to a wood lathe with the saw blade acting as the cutting element. Horizontal adjustment of either the dead centre on the tail stock or the live drive centre on the head stock permit tapered facets to be formed or tapered turned portions on the work piece, said tapers being from either end or from both ends towards an intermediate point along the work piece.

The following U.S. patents are known to the applicant.

U.S. Pat. No. 2,435,392, Feb. 3, 1948, H. T. Chaskey. This shows an adjustable automatic saw table gauge for cutting of equal lengths.

U.S. Pat. No. 2,594,651, Apr. 29, 1952, G. V. Jackson. This shows a guide for sawing machines having reciprocating carriages which includes a combined miter cut guide and lumber rest.

U.S. Pat. No. 2,715,924, Aug. 23, 1955, G. R. Norris. This shows a device for supporting a work piece perpendicular to the saw blade and cutting dowels on one end thereof.

U.S. Pat. No. 2,736,349, Feb. 28, 1956, R. M. Francis. This shows a machine for sawing contoured margins on strips or panels.

U.S. Pat. No. 2,766,785, Oct. 16, 1956, A. A. Joyal. This shows a wood working jig for holding a work piece perpendicular to the cutting elements and attaching same to the miter gauge of a table saw.

U.S. Pat. No. 2,916,063, Dec. 8, 1959, A. L. Boekenkamp. This shows a material guiding device used in conjunction with the miter gauge on a table saw for cutting slots in a surface at different angles one from the other.

U.S. Pat. No. 2,918,953, Dec. 23, 1959, R. A. Wraight. This shows a work holding attachment for circular saws which utilizes the two miter gauge slots one upon each side of the saw blade and for holding a work piece therebetween and include both horizontal and vertical adjustment for the holding means.

U.S. Pat. No. 2,941,556, June 21, 1960, F. Hammerling. This shows a tenoning attachment for table saws.

U.S. Pat. No. 2,978,814, Apr. 11, 1961, W. L. Burhans. This shows a precision hole centering and marking device for marking hole centers in a work piece supported within a machine tool such as a lathe.

U.S. Pat. No. 3,438,412, Apr. 15, 1969, J. K. Zeigler. This shows a wood working tool and work holder with a power driven router or the like associated therewith.

U.S. Pat. No. 3,786,712, Jan. 22, 1974, W. J. Mackin. This shows a saw mill log indexing device.

U.S. Pat. No. 4,132,253, Jan. 2, 1979, T. O. Mills. This shows a machine for notching pallet stringers.

U.S. Pat. No. 4,275,777, June 30, 1981, L. H. Briggs. This shows a table saw carriage attachment for forming facets on a work piece either horizontally or vertically and including vertical adjustment only for height purposes.

U.S. Pat. No. 4,441,394, Apr. 10, 1984, M. Barsotti. This shows a table saw guide apparatus having a stop device and having a work piece carrier disposed thereon. It includes a gauge device mounted upon the upper surface of the carrier for engaging the work piece and for assisting and positioning same angularly relative to the saw blade.

U.S. Pat. No. 4,516,612, May 14, 1985, E. R. Wiley. This shows a multipurpose table saw with a wood lathe attachment therefore.

U.S. Pat. No. 4,655,445, Apr. 7, 1987, J. B. Morse. This shows an apparatus for selectively positioning a work piece including index means which permits the generation of a succession of cuts in a work piece which are substantially and uniformly spaced along a reference access.

In accordance with the present invention there is provided a lathe and indexing jig for use on a table saw which includes a planar table having an upper surface and a rotatable saw blade extending therethrough, a rip fence thereon extending parallel to the rotatable saw blade and being selectively moveable and clampable across the table top in a direction perpendicular to the plane of rotation of the saw blade; said lathe and indexing jig comprising in combination a substantially rectangular bed plate, hold down means cooperating between said bed plate and the associated rip fence for mounting said bed plate upon the upper surface of the saw table for manual fore-and-aft movement thereon parallel to the plane of rotation of said saw blade and to one side thereof, a tail stock assembly adjustably mounted towards one end of said bed plate for selective and lockable fore-and-aft movement parallel to the plane of rotation of the saw blade, said tail stock including a dead centre component for engaging and supporting one end of an associated work piece, and a live centre assembly mounted towards the other end of said bed plate, said live centre assembly including a live centre component, and means to adjust said dead centre component and said live centre component independently and horizontally, parallel to the upper surface of the table top and relative to one another.

In accordance with another aspect of the invention there is provided, in combination with a table saw having a planar table with an upper surface thereon, a rotatable saw blade extending therethrough, a rip fence parallel to the plane of rotation of said saw blade, and being selectively moveable and clampable across the table top in a direction perpendicular to the plane of rotation of the said saw blade, a substantially rectangular bed plate, hold down means cooperating between said bed plate and the associated rip fence for mounting said bed plate upon the upper surface of the saw table for manual fore-and-aft movement thereon parallel to the plane of rotation of said saw blade and to one side thereof, a tail stock assembly adjustably mounted towards one end of said bed plate for selective and lockable fore-and-aft movement parallel to the plane of rotation of the saw blade, said tail stock including a dead centre component for engaging and supporting one end of an associated work piece, and a live centre assembly mounted towards the other end of said bed plate, said live centre assembly including a live centre component, and means to adjust said dead centre component and said live centre component independently and horizontally, parallel to the upper surface of the table top and relative to one another.

In accordance with a still further aspect of the invention there is provided an attachment engagable upon the upper surface of the table of a table saw which provides means to form either plain or tapered facets on a work piece or, alternatively, plain or tapered cylindrical portions on a work piece or a combination of both.

Still another aspect of the invention is to provide a device of the character herewithin described which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
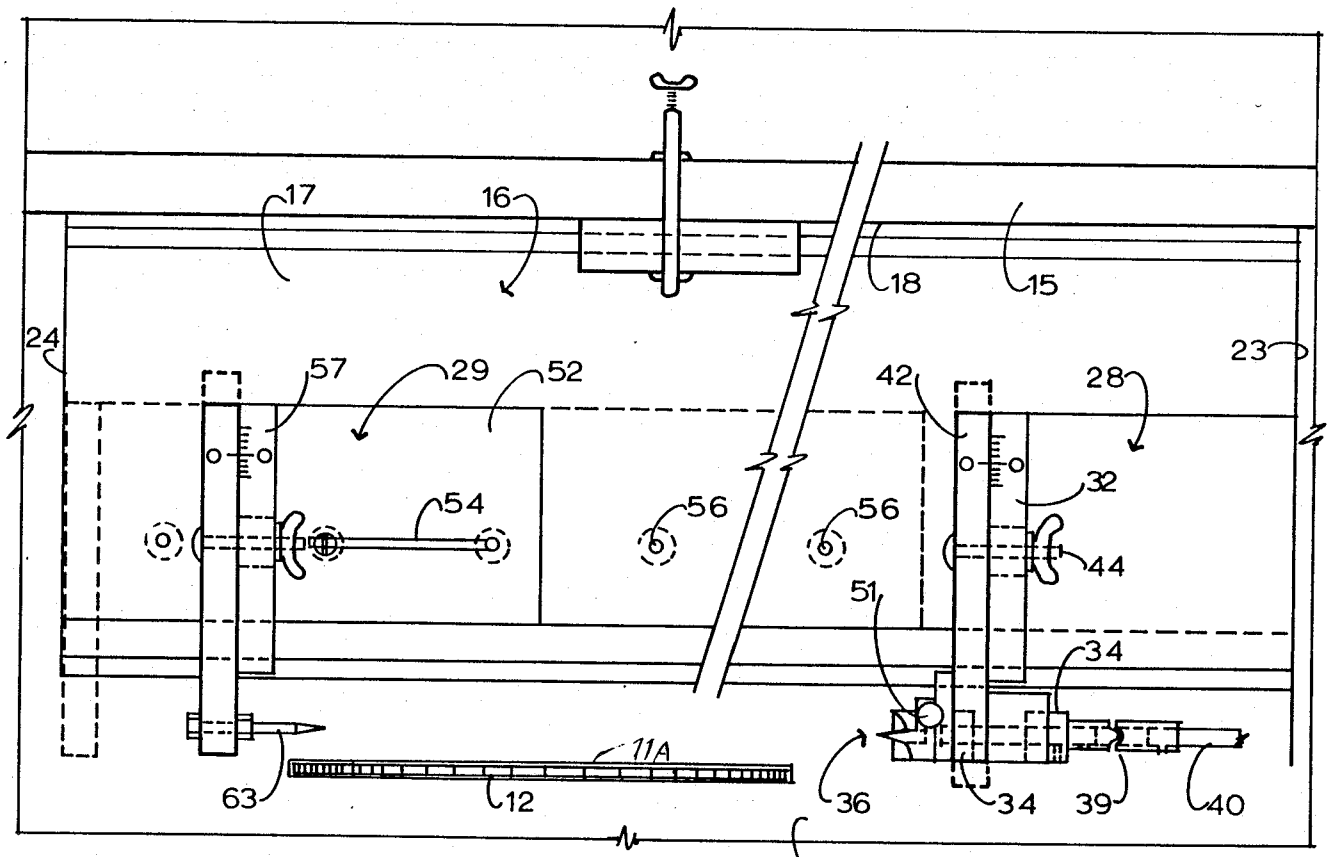
FIG. 1 is a fragmentary top plan view of the table of a table saw with the device thereon.
Figure 2:
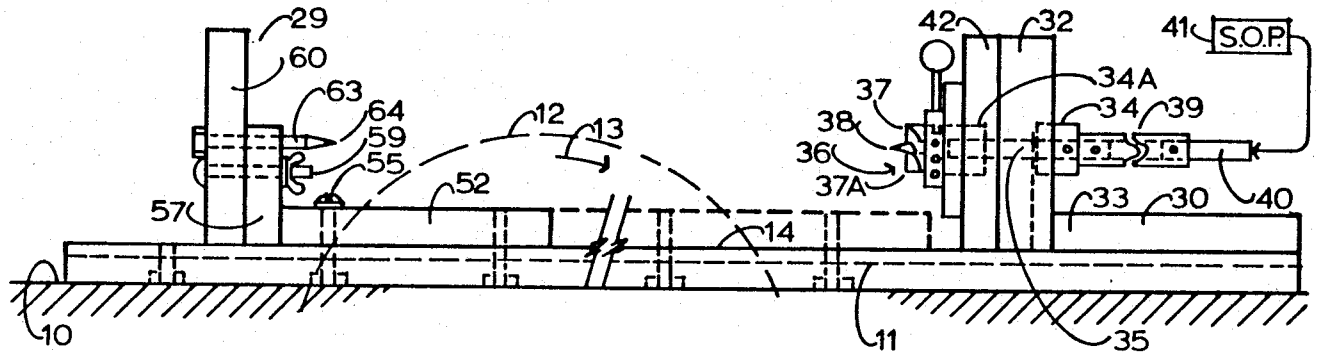
FIG. 2 is a side elevation of FIG. 1.
Figure 3:
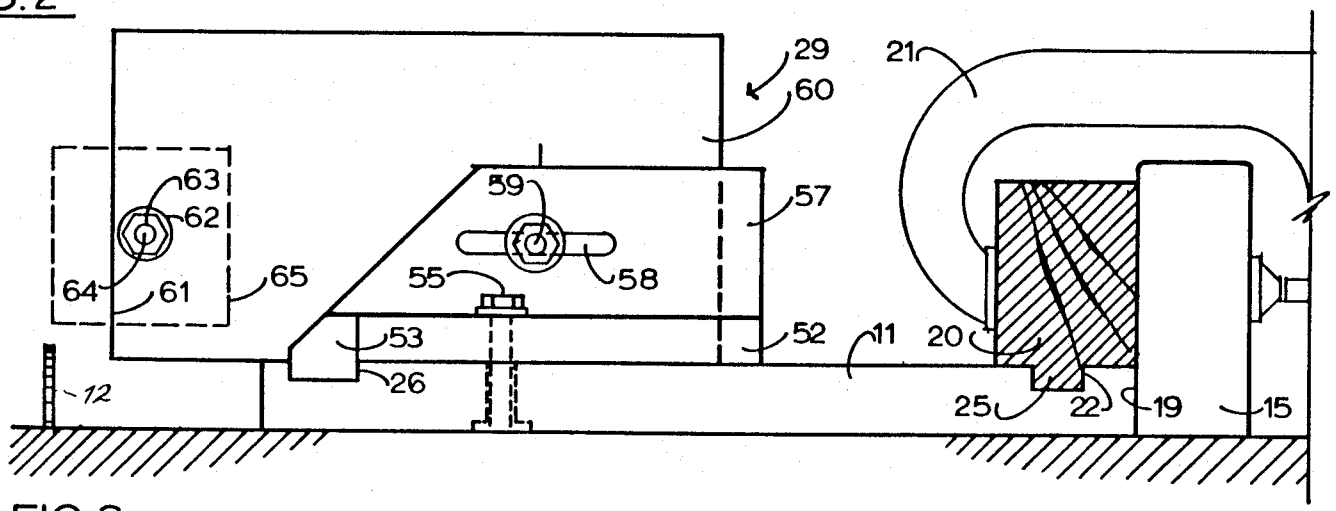
FIG. 3 is a view from the front of the saw table.

Proceeding therefore to describe the invention in detail, reference should first be made to FIGS. 1 through 4 in which 10 illustrates the table of a table saw having a slot 11A therein through which the conventional saw blade 12 extends and rotates in the direction of arrow 13 (see FIG. 2).

The table 10 includes a planar upper surface 14 and normally is provided with a conventional rip fence 15 which is situated parallel to the plane of rotation of the saw blade 12 and is moveable transversely across the table and can be clamped in any desired position in a conventional manner (not illustrated).

The invention collectively designated 16 includes a substantially rectangular bed plate 17 which engages the upper surface 14 of the table 10 and is slideable thereon in a fore-and-aft direction relative to the saw blade. It will be noted that it is situated preferably on the right hand side of the saw blade when facing from the front of the saw towards the rear. This bed plate 17 includes a longitudinal edge 18 which engages against the inner wall 19 of the rip fence 15 and is held in this position by means of a hold down block 20 held against the inner wall 19 of the rip fence by means of a conventional "C" clamp 21 (see FIG. 3).

A longitudinally extending, rectangular cross-sectioned groove 22 is formed in the upper surface of the bed 17 adjacent the longitudinal edge of the bed plate which engages the rip fence and this groove or slot 22 extends from the front edge 23 of the bed plate to the rear edge 24 thereof.

A substantially rectangular cross-sectioned projecting strip 25 extends from the underside of the hold down block and extends from the front to the rear thereof and this portion 25 slideably engages within the groove 22 and maintains the bed plate against the inner wall 19 of the rip fence. The "C" clamp 21 prevents the bed plate from moving upwardly relative to the upper surface of the saw table yet permits the fore-and-aft movement of the bed plate with the portion 25 of the hold down block sliding within the groove 22. This slot is referred to as a first slot in one or more of the attached claims.

A further slot 26, known as a second slot in some of the attached claims, is formed within the upper surface of the bed plate adjacent the other edge 27 which is adjacent the saw blade 12, and this slot also extends from front to back and is spaced and parallel to the first slot 22.

This second slot firstly permits engagement of a live centre assembly collectively designated 28 as will hereinafter be described and also a dead centre assembly collectively designated 29 as will also hereinafter be described.

The live centre assembly includes a substantially rectangular base plate 30 engageable upon the upper surface of the bed plate and including a rectangular cross-sectional downwardly extending strip 31 on the under side thereof slideably engageable within slot 26.

A rear support plate 32 extends upwardly from the front end 33 of the base plate 30 and is secured thereto and includes bearing supports 34 therewithin, to support for selective rotation, the shaft 35 of a live centre component collectively designated 36 which extends therethrough.

This live centre component 36 includes conventional edge sharpened wings 37 surrounding a centre point 38, for engagement within one end of a work piece 65 in fixed relationship therewith.

The rear end of the shaft 35 extends rearwardly of the support 32 and extends via a universal joint 39, to an attachment shaft 40 which in turn is connected to a source of power shown schematically by reference character 41 which may be engaged as desired if it is required to rotate the live centre component 36.

Figure 4:
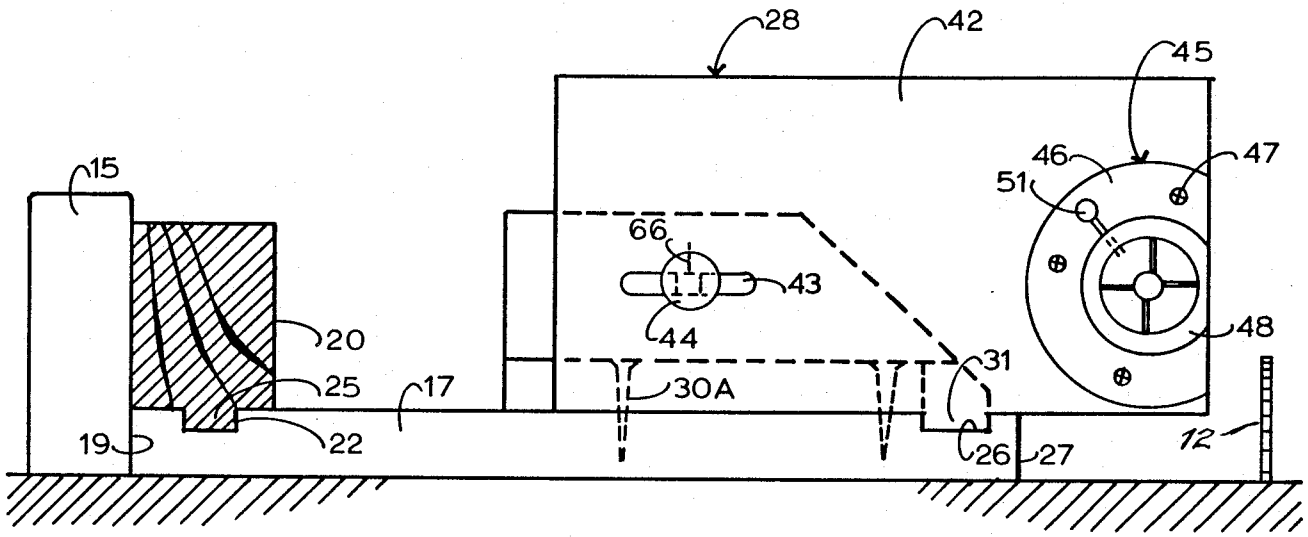
FIG. 4 is a view from the rear of the saw table top.

The front support 32 and the base 30 are secured to the bed plate by means of screws extending through the base 30 as shown in FIG. 4 by reference character 30A.

A further support plate 42 is situated vertically and bears against the rear of the fixed support 32 and is provided with a horizontal slot 43 therethrough, through which a carriage bolt 44 extends into the fixed support 32. This enables the plate 42, together with the live centre component, to be end-shifted horizontally by an amount limited by the length of slot 43. This permits tapered work to be undertaken as will hereinafter be described.

Indexing means collectively designated 45 surround and cooperate with the live centre component 36. An indexing collar 46 is secured to the rear of the support 42 by means of screws 47 and includes a rearwardly extending ring 48 having a plurality of radially extending drillings 49 and 50 extending radially therethrough and into the live centre component 36. An indexing pin 51 engages any one of these apertures and the corresponding aperture within the collar for indexing purposes and in this particular embodiment, there are two sets of such apertures, one for 45° and 90° indexing for forming squares and octagons and the other for 60° and 120° for triangles and hexagons.

It should be noted that when the indexing pin is engaged with the live centre component, same cannot be rotated but when disengaged, it may be rotated either by the source of power or manually for re-indexing purposes.

The aforementioned tail stock 29 also includes a rectangular base plate 52 having a downwardly depending rectangular cross-sectioned strip 53 engageable within the aforementioned second slot 26 for sliding movement there along.

It includes a fore-and-aft extending closed-ended slot 54 through which a nut and bolt assembly 55 extends with the bolt being held within the bed 11 and extending upwardly therefrom.

This permits fore-and-aft movement of the base plate together with the tail stock assembly 29, to the limits of the length of the slot 54. Selected apertures 56 may be provided through the bed plate so that a greater range of adjustment is available.

The tail stock assembly includes a fixed support plate 57 extending upwardly from the base 52 adjacent the rear end thereof.

A horizontal slot 58 is formed through this fixed support 57 and a nut and bolt assembly 59 extends through this slot and is secured to a rear support plate 60 situated against the rear side of the front support 57. This rear support is moveable horizontally through the limits defined by the length of slot 58 and can be clamped in the desired position by means of the nut and bolt assembly 59.

Adjacent the vertical edge 61 of the plate 60, there is provided a tail stock assembly 62 having a dead centre component 63 located thereon having a conical tip 64 thereon which engages a work piece such as that indicated by reference character 65 and permits same to rotate freely thereon in a conventional manner.

In operation, the hold down block 20 is positioned to hold the bed plate 11 against the inner wall of the rip fence and upon the upper surface of the saw table 11 so that the bed plate may be moved fore-and-aft parallel to the saw blades 12. The bed plate together with the rip fence are adjusted relative to the saw blade and the rip fence is clamped to the table.

A work piece such as 65 is engaged with the drive centre for rotation thereby and by the dead centre 63 with the tail stock assembly being moved along the slot 26 and locked in position by the nut and bolt assembly 55.

If it is desired to turn a parallel-sided cylindrical portion on the work piece 65, the index pin 51 is disengaged from the drive centre component 36 and the source of power 41 is energized to rotate the drive centre component together with the work piece via the portions 37. For parallel-sided cylindrical portions, both the head stock assembly 28 and the tail stock assembly 29 are centered within the slots 43 and 58 respectively utilizing index marks 66 associated therewith. The bed plate is moved towards the saw blade by releasing the rip fence and moving it transversely the required amount whereupon it is clamped into position.

The bed plate together with the work piece is then moved in fore-and-aft direction so that the saw blade engages either the full or partial length of the work piece upon which it is desired to form the parallel-sided cylindrical portion. This is continued until this portion is completed.

If on the other hand it is desired to form the cylindrical portion in a taper, then either the head stock or tail stock is end-shifted via the slots 43 and 58, in amounts sufficient to form the desired taper and the process is repeated.

If it is desired to form facets on all or part of the work piece then the source of power 41 is disengaged and the indexing assembly 45 is utilized.

Under these circumstances it is often desirable to position the work piece in the most efficient position possible.

Figure 6:
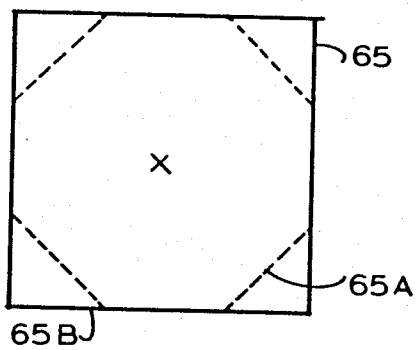
FIG. 6 is an end view of a work piece in the preferred position for forming a six sided configuration.

As an example, if an eight sided portion is required on the work piece, which starts off as a square cross-sectional configuration as shown in FIG. 6 then it will become apparent that there are four common sides and if the dimensions are correct, then it is necessary to position the work piece so that cuts can be made as indicated in phantom by reference character 65A.

It is therefore desirable to align one of the original faces 65B in a horizontal position and one method of doing this is to mark one of the blades 37 by grinding off a corner as indicated by reference character 37A in FIG. 2.

Figure 7:
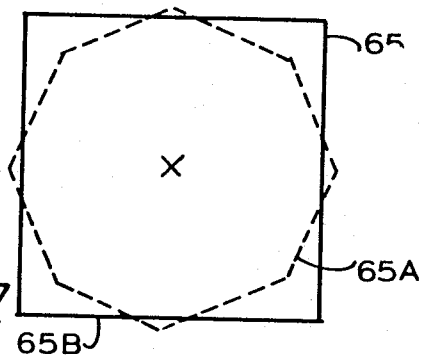
FIG. 7 is a view similar to FIG. 6 but showing a less preferred position.
Figure 9:
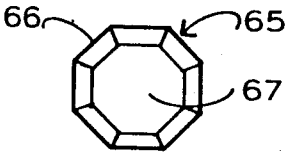
FIG. 9 is an end view of FIG. 8.
Figure 5:
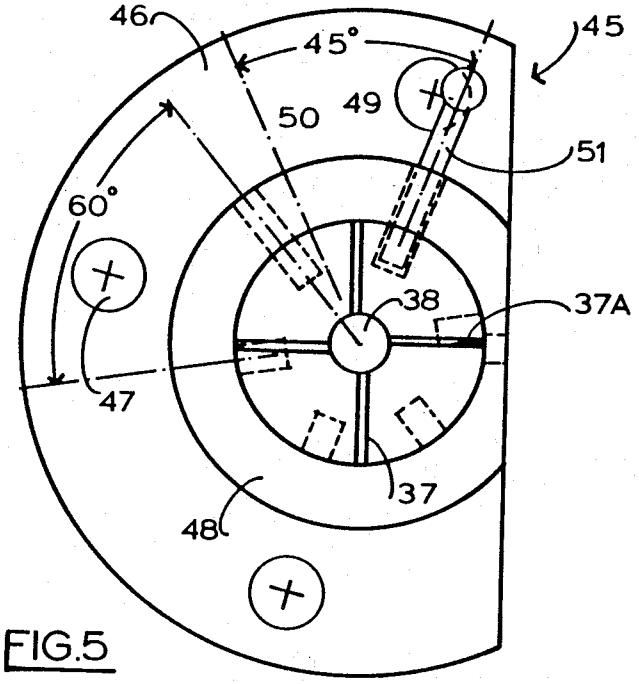
FIG. 5 is an enlarged end view of the drive center and indexing collar per say.

As the indexing apertures are fixed, it is necessary to engage the drive centre in the correct relationship to ensure that the first indexing is such that one of the sides 65A is vertical with the saw blade. It is therefore necessary to engage the marked spur or flange 37A so that it is 90° to one of the original sides 65B of the work piece thus positioning the work piece correctly. If not, then a situation as illustrated in FIG. 7 may result which means that perhaps the desired size of the finished part cannot be obtained from the original work piece.

Figure 8:
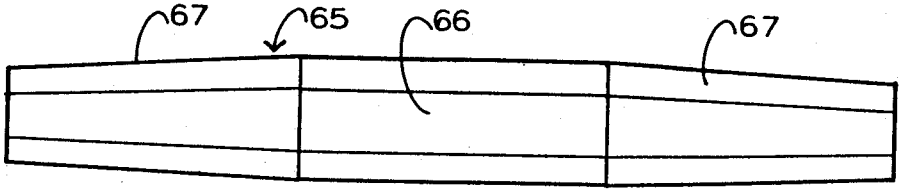
FIG. 8 is a side elevation showing a faceted work piece with both ends tapering towards a central portion.

If it is desired that the faceted work piece also be tapered either along the complete length or from each end towards the centre as shown for example in FIG. 8, then either the head stock or tail stock assemblies or both may be end-shifted within the horizontal slots 43 and 58 to obtain the desired result whereupon the bed plate is moved by the rip fence and clamped into the desired position to make the desired cuts in the work piece which is indexed through the required number of positions in order to produce the desired result whether it be triangular, or hexagonal, or square or octagonal.

FIG. 8 shows an example of a work piece which has eight sided facets formed along a central area 66 with tapered portions 67 extending from each end thereof to the ends of the central portion 66.

Similar tapered and parallel configurations can of course be made when in the cylindrical mode and the live centre component being rotated by the source of power. It will be appreciated that a combination of both are easily obtained by use of this device.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A lathe and indexing jig for use on a table saw which includes a planar table having an upper surface and a rotatable saw blade extending therethrough, a rip fence thereon extending parallel to the rotatable saw blade and being selectively moveable and clampable across the table top in direction perpendicular to the plane of rotation of the saw blade; said lathe and indexing jig comprising in combination a substantially rectangular bed plate, hold down means cooperating between said bed plate and the associated rip fence for mounting said bed plate upon the upper surface of the saw table for manual fore-and-aft movement thereon parallel to the plane of rotation of said saw blade and to one side thereof, a tail stock assembly adjustably mounted towards one end of said bed plate for selective and lockable fore-and-aft movement parallel to the plane of rotation of the saw blade, said tail stock including a dead centre component for engaging and supporting one end of an associated work piece, and a live centre assembly mounted towards the other end of said bed plate, said live centre assembly including a live centre component, and means to adjust said dead centre component and said live centre component independently and horizontally, parallel to the upper surface of the table top and relative to one another.

2. The jig according to claim 1 in which said bed plate includes a first slot formed in the upper surface adjacent to and extending parallel to the associated rip fence, said hold down means including a hold down block selectively clampable to said rip fence and overlying said first slot and means extending downwardly from the underside of said block slideably engaging within said first slot, the edge of said bed plate slideably contacting the inside wall of the associated rip fence, said block holding said bed plate in contact with the upper surface of said saw table.

3. The jig according to claim 1 in which said bed plate includes a second slot formed in the upper surface thereof and extending parallel to the associated rip fence adjacent the edge of said bed plate adjacent the associated saw blade, said tail stock including means extending downwardly therefrom slideably engaging said slot for said selective fore-and-aft movement relative to said bed.

4. The jig according to claim 2 in which said bed plate includes a second slot formed in the upper surface, said second slot extending parallel but spaced from said first slot and adjacent the edge of said bed plate adjacent the associated saw blade, said tail stock including means extending downwardly therefrom and slideably engaging said second slot for said selective fore-and-aft movement relative to said bed plate.

5. The jig according to claim 1 in which said tail stock includes a base plate slideably engagable upon said bed plate and a support plate extending upwardly from said base plate, said dead centre component being selectively secured to said support plate, said means to adjust said dead centre component including a horizontal slot in said support plate, said dead centre component being selectively secured to said support plate through said horizontal slot and being selectively moveable therealong.

6. The jig according to claim 2 in which said tail stock includes a base plate slideably engagable upon said bed plate and a support plate extending upwardly from said base plate, said dead centre component being selectively secured to said support plate, said means to adjust said dead centre component including a horizontal slot in said support plate, said dead centre component being selectively secured to said support plate through said horizontal slot and being selectively moveable therealong.

7. The jig according to claim 1 which includes means to selectively index said live centre assembly, circumferentially.

8. The jig according to claim 2 which includes means to selectively index said live centre assembly, circumferentially.

9. The jig according to claim 1 which includes a source of power to selectively rotate said live centre component and hence a work piece extending between said live centre component and said dead centre component.

10. The jig according to claim 2 which includes a source of power to selectively rotate said live centre component and hence a work piece extending between said live centre component and said dead centre component.

11. The jig according to claim 3 which includes a source of power to selectively rotate said live centre component and hence a work piece extending between said live centre component and said dead centre component.

12. The jig according to claim 8 in which said live centre assembly includes a base plate secured to said bed plate in the fixed location and a support plate extending upwardly from said base plate, said live centre component being selectively secured to said support plate, said means to adjust said live centre component including a horizontal slot in said support plate, said live centre component being selectively secured to said support plate through said horizontal slot.

13. The jig according to claim 6 in which said means to selectively index said live assembly circumferentially includes a stationary indexing collar secured to said live centre assembly, said drive centre being selectively adjustable rotationally within said collar and index pin means extending through said collar and into any one of a plurality of pin engaging apertures in said drive centre component, to adjustably lock said component to said collar.

14. The jig according to claim 7 in which said means to selectively index said live assembly circumferentially includes a stationary indexing collar secured to said live centre assembly, said drive centre being selectively adjustable rotationally within said collar and index pin means extending through said collar and into any one of a plurality of pin engaging apertures in said drive centre component, to adjustably lock said component to said collar.

15. In combination with a table saw having a planar table with an upper surface thereon, a rotatable saw blade extending therethrough, a rip fence parallel to the plane of rotation of said saw blade, and being selectively moveable and clampable across the table top in a direction perpendicular to the plane of rotation of the said saw blade, a substantially rectangular bed plate, hold down means cooperating between said bed plate and the associated rip fence for mounting said bed plate upon the upper surface of the saw table for manual fore-and-aft movement thereon parallel to the plane of rotation of said saw blade and to one side thereof, a tail stock assembly adjustably mounted towards one end of said bed plate for selective and lockable fore-and-aft movement parallel to the plane of rotation of the saw blade, said tail stock including a dead centre component for engaging and supporting one end of an associated work piece, and a live centre assembly mounted towards the other end of said bed plate, said live centre assembly including a live centre component, and means to adjust said dead centre component and said live centre component independently and horizontally, parallel to the upper surface of the table top and relative to one another.

16. The combination according to claim 14 in which said bed plate includes a first slot formed in the upper surface adjacent to and extending parallel to the associated rip fence, said hold down means including a hold down block selectively clampable to said rip fence and overlying said first slot and means extending downwardly from the underside of said block slideably engaging within said first slot, the edge of said bed plate slideably contacting the inside wall of the associated rip fence, said block holding said bed plate in contact with the upper surface of said saw table.

17. The combination according to claim 1 in which said bed plate includes a second slot formed in the upper surface thereof and extending parallel to the associated rip fence adjacent the edge of said bed plate adjacent the associated saw blade, said tail stock including means extending downwardly therefrom slideably engaging said slot for said selective fore-and-aft movement relative to said bed.

18. The jig according to claim 8 in which said live centre component is journalled for rotation within said live centre assembly, means to selectively connect said live centre component to a source of power, said means comprising means to index said live centre assembly circumferentially, said last mention means to index said live centre assembly including a stationary indexing collar secured to said live centre assembly, said live centre component being selectively adjustable rotationally within said collar and index pin means extending through said collar and engaging said live centre component, disengagement of said index pin means freeing said live centre component for rotation.

19. The jig according to claim 9 in which said live centre component is journalled for rotation within said live centre assembly, means to selectively connect said live centre component to a source of power, said means comprising means to index said live centre assembly circumferentially, said last mention means to index said live centre assembly including a stationary indexing collar secured to said live centre assembly, said live centre component being selectively adjustable rotationally within said collar and index pin means extending through said collar and engaging said live centre component, disengagement of said index pin means freeing said live centre component for rotation.

20. The jig according to claim 10 in which said live centre component is journalled for rotation within said live centre assembly, means to selectively connect said live centre component to a source of power, said means comprising means to index said live centre assembly circumferentially, said last mention means to index said live centre assembly including a stationary indexing collar secured to said live centre assembly, said live centre component being selectively adjustable rotationally within said collar and index pin means extending through said collar and engaging said live centre component, disengagement of said index pin means freeing said live centre component for rotation.

* * * * *